US008656732B2

(12) United States Patent
Funder-Kristensen et al.

(10) Patent No.: US 8,656,732 B2
(45) **Date of Patent: *Feb. 25, 2014**

(54) REFRIGERATION SYSTEM

(75) Inventors: Torben Funder-Kristensen, Soenderborg (DK); Holger Nicolaisen, Nordborg (DK); Joergen Holst, Sydals (DK); Mogens H. Rasmussen, Baltimore, MD (US); Jan Holm Nissen, Augustenborg (DK)

(73) Assignee: Danfoss A/S, Nordborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/451,872

(22) Filed: Apr. 20, 2012

(65) Prior Publication Data

US 2012/0198876 A1 Aug. 9, 2012

Related U.S. Application Data

(63) Continuation of application No. 12/278,158, filed as application No. PCT/DK2007/000067 on Feb. 9, 2007, now Pat. No. 8,191,384.

(30) Foreign Application Priority Data

Feb. 13, 2006 (DE) ..... 10 2006 006 731

(51) Int. Cl.
*F25B 39/02* (2006.01)
*F17D 3/00* (2006.01)

(52) U.S. Cl.
USPC ..... 62/504; 62/525; 137/624.15

(58) Field of Classification Search
USPC ..... 62/504, 524, 525, 527, 528, 222; 137/624.14, 624.15, 625.11, 625.12, 137/625.15
See application file for complete search history.

(56) References Cited

U.S. PATENT DOCUMENTS 6,370,908 B1 * 4/2002 James ..... 62/434
8,191,384 B2 * 6/2012 Funder-Kristensen et al. . 62/504

FOREIGN PATENT DOCUMENTS

WO WO 9427040 A1 * 11/1994

* cited by examiner

*Primary Examiner* — Chen Wen Jiang
(74) *Attorney, Agent, or Firm* — McCormick, Paulding & Huber LLP

(57) ABSTRACT

The invention concerns a refrigeration system comprising a refrigerant circuit which comprises several evaporator paths and a distributor (5) which distributes the refrigerant on the evaporator paths. The aim of the invention is to improve the operation of said refrigeration system in a simple manner. According to the invention, the distributor (5) comprises a controllable valve (12) for each evaporation path.

20 Claims, 3 Drawing Sheets

REFRIGERATION SYSTEM

CROSS REFERENCE TO RELATED APPLICATIONS

This application is a continuation of U.S. patent application Ser. No. 12/278,158, filed on Feb. 9, 2009, which is entitled to the benefit of and incorporates by reference essential subject matter disclosed in International Patent Application No. PCT/DK2007/000067 filed on Feb. 9, 2007 and German Patent Application No. 10 2006 006 731.2 filed Feb. 13, 2006, each of which applications is hereby incorporated by reference in its entirety.

TECHNICAL FIELD

The invention concerns a refrigeration system with a refrigerant circuit comprising several evaporation paths and a distributor causing a distribution of refrigerant to the evaporation paths.

BACKGROUND OF THE INVENTION

Such a refrigeration system is known from U.S. Pat. No. 5,832,744. The distributor comprises a valve arranged between a refrigerant inlet and several refrigerant outlets, the valve being connected in series after a rotating turbine disc. The purpose of the turbine disc is to ensure that the refrigerant is distributed evenly to all outlets of the distributor and thus also evenly to all evaporators.

A further distributor, which can be used in such a refrigeration system, is known from U.S. Pat. No. 6,898,945 B1. Here, a valve is located between an inlet and several outlets, a pressure drop over the distributor being adjustable with said valve. The valve comprises a conical pin for the distribution of the supplied refrigerant, so that the refrigerant can be distributed to the various circuits of through the evaporator.

In theory, the known distributors ensure an even distribution of the refrigerant to the individual evaporators. However, even small differences in the dimensions, which could, for example, occur during manufacturing, cause an uneven distribution to the individual evaporators. Further, for such distributors, it is necessary that the individual evaporators have basically the same thermal load and the same flow resistance. If this is not the case, it may happen that an evaporator receives too much refrigerant, so that the refrigerant is not completely evaporated before having passed through the evaporator. Another evaporator, which is connected to the same distributor, can receive too little refrigerant, so that the evaporator cannot supply the required refrigeration output. The oversupply or the undersupply, respectively, of the evaporator may particularly cause problems, if temperature sensors, which are arranged at the evaporators or in other locations of the refrigeration system, control an expansion valve. Under unfavourable circumstances, the expansion valve can start oscillating naturally, which will further deteriorate the capacity and the efficiency of the refrigeration system.

BRIEF SUMMARY OF THE INVENTION

The invention is based on the task of improving the operation of the refrigeration system with simple means.

With a refrigeration system as mentioned in the introduction, this task is solved in that, for each evaporation path, the distributor comprises a controllable valve.

When, in the following, a "refrigeration system" is mentioned, this is to be understood in the broadest sense of the word. It particularly comprises refrigeration systems, freezing systems, air-conditioning systems and heat pumps. The word "refrigeration system" is merely used for reasons of simplicity. The evaporation paths can be arranged in different evaporators. For reasons of simplicity, the invention is explained in connection with several evaporators. However, the invention can also be used, if one evaporator comprises several evaporation paths, which can be controlled individually or in groups.

If the distributor comprises a controllable valve for each evaporator, it can control the supply of the evaporator individually, that is, it is then possible to supply each evaporator with the amount of refrigerant, which it requires. It must no longer be considered that all evaporators must have the same flow resistance. It is also of inferior importance, if the evaporator has to supply different refrigeration outputs. An evaporator, from which a large refrigeration output is required, receives correspondingly more refrigerant than an evaporator, which has to supply a smaller refrigeration output.

Preferably, the valves are controlled by a control device, which controls the individual valves differently. The control device thus ensures the distribution of the refrigerant to the individual evaporators.

Preferably, the control device controls only one single valve so that it comprises an inlet opening, which is larger than the inlet opening of the other valves. If, usually, all valves are closed, the control device then only opens one valve at a time. This simplifies the control and the batching of the refrigerant to be supplied to each individual evaporator.

Preferably, the control device comprises a rotor, which causes the opening of valves. Thus, the individual valves are opened by the rotation of the rotor. This is a very simple possibility of controlling the individual valves individually one after the other.

Preferably, the rotor is driven by a motor with variable speed. A change of the speed will then permit a setting of the opening duration of the individual valves. The fact that the speed can be changed permits that one valve can be kept open longer than another valve. This permits individual control.

Preferably, the motor is reversible. The reversibility of the motor permits one single valve to be completely closed also for a longer period. Before the rotor causes this valve to open, the rotation direction of the motor is reversed, so that the valve remains closed. It is also possible to let more valves remain closed, if these valves are arranged next to each other in the rotation direction of the rotor.

Preferably, the rotor is connected to a cam disc and the valves comprise valve tappets, which are operable by the cam disc. This is a particularly simple, mechanical solution of opening and closing the valves. Expediently, the valves are acted upon in the closing direction by a closing spring. If then the cam gets in contact with the tappet, the valve is opened against the force of the closing spring. The valve closes again, as soon as the cam has continued its rotation far enough.

Preferably, the cam disc comprises one single cam. Thus, it is ensured that only one valve at a time can be opened or opened more than the other valves. Accordingly, it is also possible to set the opening duration (or the duration of the additional opening) of each individual valve separately, so that to a high degree the opening duration is not influenced by the opening durations of the other valves.

It is preferred that in the rotation direction the valve tappets have a distance from one another, which is at least as large as the extension of the cam in the rotation direction. Thus, it is possible to let the cam come to rest in a position, in which it does not act upon any of the valve tappets. In this case, all valves can remain closed.

Preferably, the valve tappets are arranged in parallel to the rotor axis. Here, the term "parallel" is not to be understood in the exact mathematic sense of the word. It is merely essential that the valve tappets comprise a component, which is aligned in parallel to the rotor axis. In this case, the cam, which is arranged on the cam disc, acts in parallel to the rotor axis.

Preferably, the cam disc comprises a displacement drive, which acts in a direction parallel to the rotor axis. If the valve tappet is arranged in parallel to the rotor axis, the displacement of the cam disc is a simple way of enable all valves to open at the same time to permit a certain basic flow of refrigerant. The cam then opens one single valve more than the other valves to ensure an individual supply of one single evaporator with refrigerant.

In an alternative embodiment it may be provided that the rotor comprises an axially extending inlet channel, which is connected to an inlet of the distributor, and a radially extending outlet channel, whose opening can be brought to overlap during a rotation with outlet openings, which are connected to the evaporators. Thus, the rotor is at the same time used as an element of the valve. If the opening of the outlet channel overlaps an outlet opening, a flow path is released from the inlet of the distributor to an outlet, which is allocated to a specific evaporator. As long as the overlap exists, refrigerant can flow from the inlet of the distributor to the evaporator in question. When the rotor is turned further, the refrigerant supply to the evaporator mentioned above is interrupted, and the next outlet in the rotation direction is supplied with refrigerant. Depending on the duration of the overlap between the opening of the outlet channel and the outlet opening, a larger or smaller amount of refrigerant can flow into the evaporator. This overlap duration can be changed in dependence of the speed, with which the rotor rotates.

Preferably, the outlet openings have a distance to each other in the rotation direction, which is at least as large as the extension of the opening of the outlet channel in the rotation direction. In this case, it is possible to stop the rotor in a position, in which the opening of the outlet channel does not overlap an outlet opening, so that the refrigerant supply to all evaporators is interrupted. For example, such a position can be used to defrost the evaporators.

It is also advantageous, if a sensor, which is connected to the control device, is arranged in each evaporation path. This sensor can, for example, be a temperature sensor. Each evaporator can then be supplied with refrigerant in dependence of the temperature at its outlet.

In an alternative embodiment it may be ensured that the evaporator paths are connected in series with a condenser, and a sensor is arranged in front of the condenser or the compressor. In this case, only one sensor measuring, for example the temperature, is required. One single sensor will be sufficient, if otherwise the operation behaviour of the refrigeration system is known. With the knowledge of the operation behaviour, it can then be decided, how much refrigerant shall be supplied to which evaporator or evaporation path.

BRIEF DESCRIPTION OF THE DRAWINGS

In the following, the invention is described on the basis of preferred embodiments in connection with the drawings, showing.

DETAILED DESCRIPTION OF THE PREFERRED EMBODIMENTS

Figure 1:
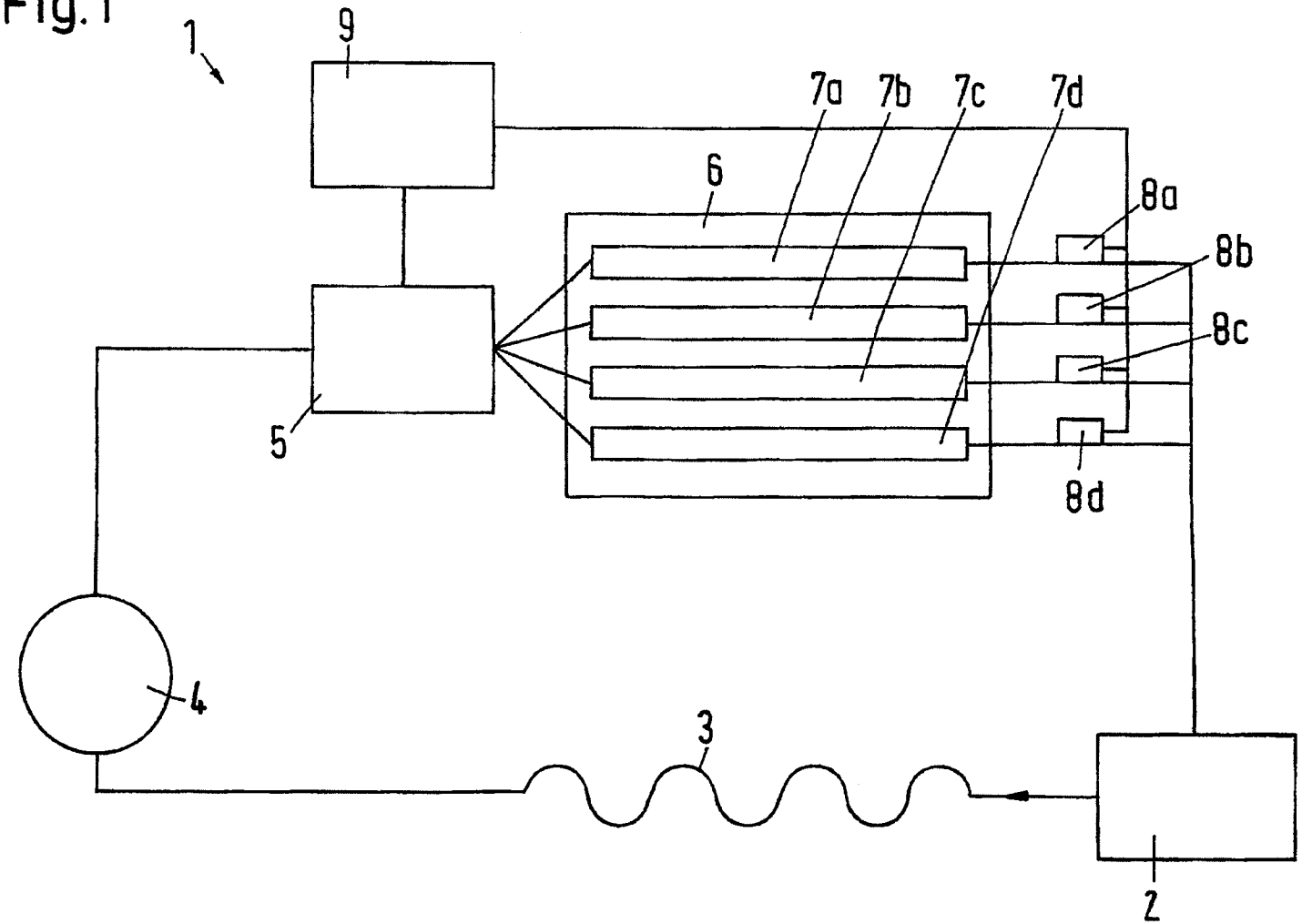
FIG. 1 is a schematic view of a refrigeration system with several evaporators.

FIG. 1 is a schematic view of a refrigeration system 1, in which a compressor 2, a condenser 3, a collector 4, a distributor 5 and an evaporator arrangement 6 with several evaporators 7*a*-7*d*, arranged in parallel, are connected in a circuit. The evaporator arrangement 6 can also comprise one single evaporator, which comprises several evaporation paths to be controlled individually or in groups.

In a manner known per se, liquid refrigerant is evaporated in the evaporators 7*a*-7*d*, compressed in the compressor 2, condensed in the condenser 3 and collected in the collector 4. The distributor 5 is provided for distributing the liquid refrigerant to the individual evaporators 7*a*-7*d*.

A temperature sensor 8*a*-8*d* is arranged at the outlet of each evaporator 7*a*-7*d*. The temperature sensor 8*a*-8*d* senses the temperature of the refrigerant leaving the evaporator 7*a*-7*d*. The temperature information is supplied to a control unit 9, which controls the distributor 5 in dependence of the temperature signals of the temperature sensors 8*a*-8*d*.

Figure 2:
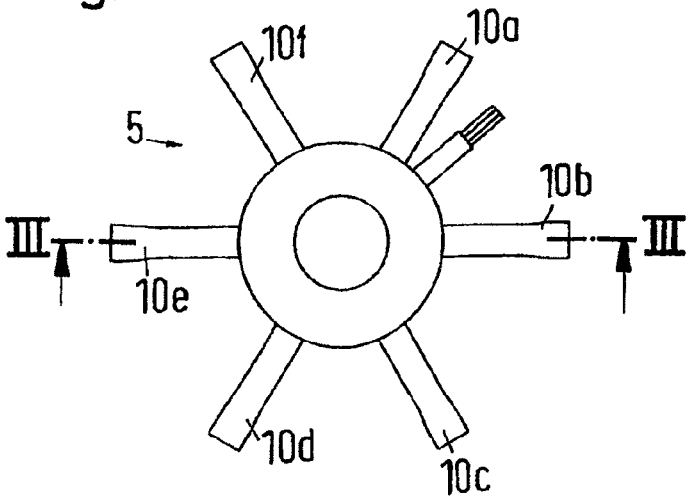
FIG. 2 is a top view of a first embodiment of a distributor.
Figure 3:
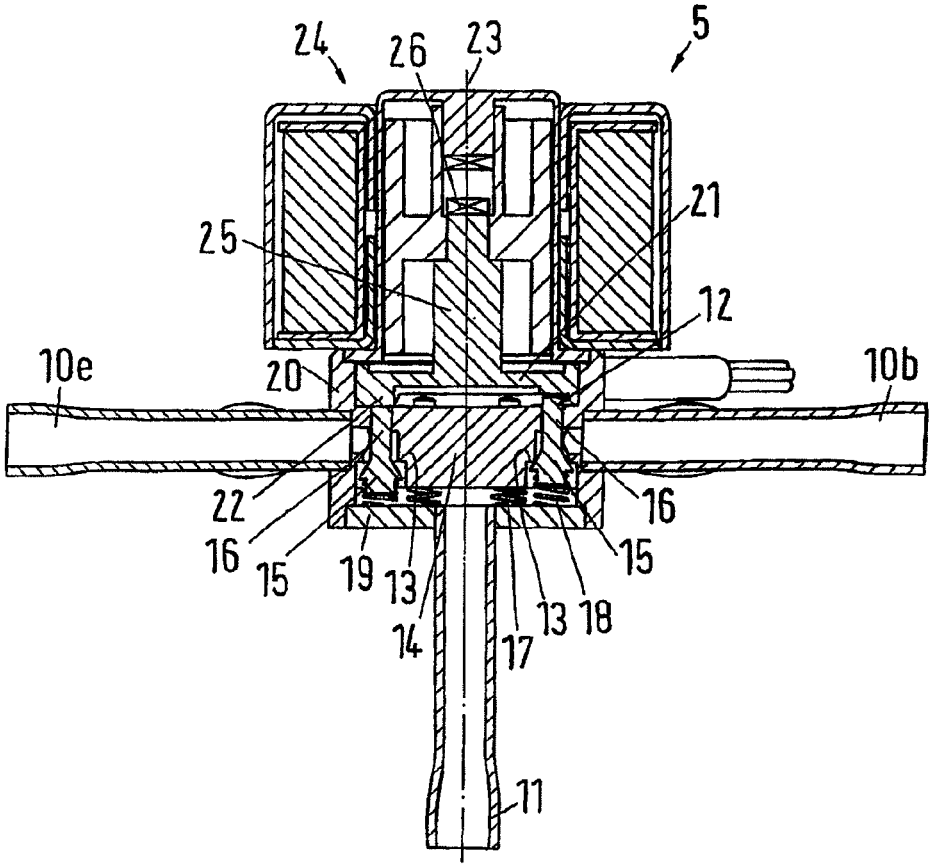
FIG. 3 is a section III-III according to FIG. 2.

The FIGS. 2 and 3 show a first embodiment of a distributor 5. The distributor 5 according to FIG. 2 comprises six outlets 10*a*-10*f* (for six evaporators) and an inlet 11. Each outlet 10*a*-10*f* is separated from the inlet 11 by a valve 12. As all the valves have the same design, the following description is made on the basis of valves 12 allocated to the outlets 10*b*, 10*e*.

Each valve 12 comprises a valve seat 13, which is arranged in a housing block 14. Further, each valve 12 comprises a valve element 15, which is connected to a valve tappet 16 extending from the side of the housing block 14 on the side facing away from the valve seat 13. Both the housing block 14 and the valve element 15 rest on a cover 19 via springs 17, 18, through which cover 19 the inlet 11 is led and which closes a valve housing 20. The spring 18 is made as a closing spring, which acts upon the valve element 15 in the direction of the valve seat 13.

A cam disc 21 is arranged to be rotatable in the valve housing 20. The cam disc 21 comprises one single cam 22, which acts upon a valve tappet 16 during a rotation of the cam disc 21 around a rotation axis 23, as can be seen through the left valve (in FIG. 3). When the cam 22 acts upon the valve tappet 16, the valve element 15 lifts off from the valve seat 13, and a passage from the inlet 11 to the outlet 10*e* is released. As soon as the cam 22 leaves the valve tappet 16, the spring 18 brings the valve element 15 to rest on the valve seat 13 again, and the corresponding valve 12 closes, as can be seen by the valve 12 allocated to the outlet 10*b*.

The cam disc 21 is rotated by a motor 24, which is only shown schematically here. The motor 24 is controlled by the control unit 9. The motor 24 can be driven with a controlled speed. The maximum speed is, for example, in the order of 100 rpm. During a rotation, the speed of the motor 24 can, as mentioned, be changed. The motor 24 can also be stopped for a short while. Also the rotation direction of the motor can be changed.

Thus, the following operation can be realised:

In dependence of the signals from the temperature sensors 8*a*-8*d* each of the individual valves 12 is opened during a rotation of the cam disc 21 for so long that a sufficient amount of refrigerant can flow through the individual outlets 10*a*-10*f*, so that the evaporators 7*a*-7*d* receive sufficient, but not too much, refrigerant. If an evaporator requires a smaller amount of refrigerant, the cam disc 21 is, when the cam 22 acts upon the corresponding tappet 16 of the valve 12, rotated faster, so that the valve 12 only remains open for a shorter while. If, however, an evaporator should require a larger amount of refrigerant, the cam disc 21 would, when the cam 22 is in the area of the valve allocated to the corresponding outlet, rotate slower.

As each evaporator receives refrigerant at least once during a period of one second, it can be achieved that the pressure in the evaporator varies only slightly, so that a negative influence on the refrigeration system 1 must not be feared.

The cam disc 21 is supported on a rotor 25 of the motor 24. The rotor 25 can now, via an axial drive 26, be displaced in a direction in parallel to the rotation axis 23. If it is, for example, displaced downwards (in relation to the view in FIG. 3), all valves 12 are somewhat opened, so that refrigerant can permanently flow through all outlets 10*a*-10*f*. This results in a certain basic supply to all evaporators. The exact setting of the refrigerant amount to be supplied to the individual evaporator then still takes place via the cam 22 of the cam disc 21.

In the circumferential or rotation direction of the cam disc 21, the individual valves 12 have a mutual distance, which is at least exactly as large as the extension of the cam 22 in the circumferential direction. Accordingly, it is possible to stop the cam disc 21 in a position, in which no valve has been opened. Such a position is, for example, assumed, if no evaporator requires a supply of refrigerant.

With the distributor 5 it is also possible to defrost individual evaporators. In this case, the rotation direction of the cam disc 21 would be reversed, before the cam 22 reaches the valve 12 allocated to this evaporator. Thus, this valve 12 is not opened. This valve 12 can be kept closed, until the evaporator has been defrosted. The remaining valves 12 will still be opened by the cam 22 in the manner described above.

Figure 4:
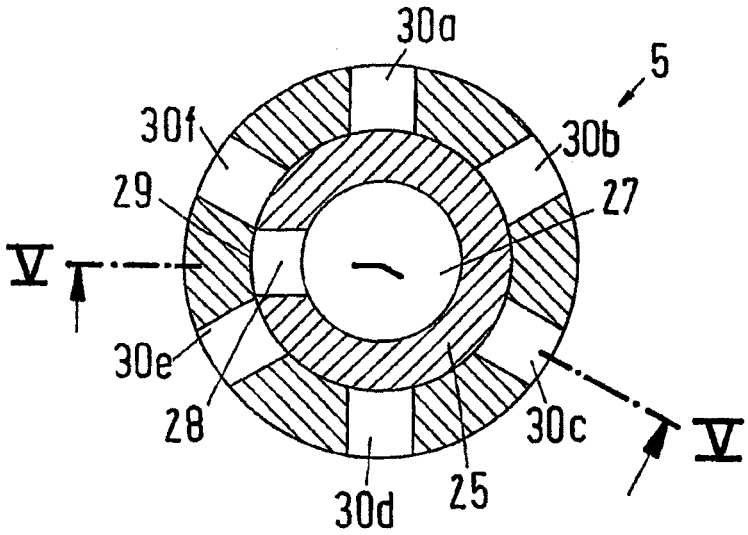
FIG. 4 is a sectional view IV-IV according to FIG. 5 through a second embodiment of a distributor.
Figure 5:
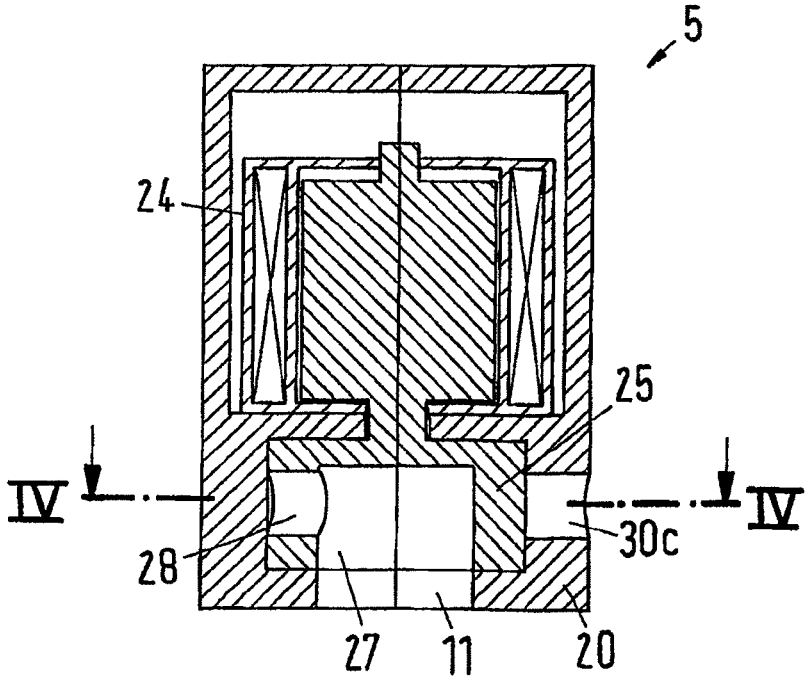
FIG. 5 is a sectional view V-V according to FIG. 4.

The FIGS. 4 and 5 show a modified embodiment of a distributor 5, in which the same elements and elements with the same function have the same reference numbers.

The distributor of FIGS. 4 and 5 also comprises a rotor 25. The rotor 25 comprises an inlet channel 27, which is constantly overlapping the inlet 11 of the valve housing 20, that is, independently of the rotation position of the rotor 25.

The rotor 25 also comprises an outlet channel, which substantially has a radial direction. The outlet channel 28 comprises an opening 29, which overlaps the outlet openings 30*a*-30*f* during a rotation of the rotor 25. The outlet openings 30*a*-30*f* again are connected to the outlets 10*a*-10*f*, through which a connection to the evaporators of the evaporation arrangement 6 can be created.

Also here, the distance between the outlet openings 30*a*-30*f* is at least as large as the extension of the opening 29 of the outlet channel 28 in the circumferential direction. In the position of the rotor 25 shown in FIG. 4, the outlet channel 28 is therefore closed, so that no refrigerant can be distributed.

Otherwise, the mode of operation of the distributor 5 is the same as in the embodiment of the distributor 5 shown in FIGS. 2 and 3.

Controlled by the control unit 9, the rotor 25 is controlled at, under certain circumstances, varying rotation speeds in such a manner that a connection between the inlet 11 and one of the outlet openings 30 is always available for a certain period. During this period, refrigerant can flow from the inlet 11 into the corresponding outlet opening 30*a*-30*f*, and from here to the connected evaporator, which is accordingly acted upon by a predetermined amount of refrigerant. If the rotor 25 rotates slowly, while the opening 29 passes over the corresponding outlet opening 30*a*-30*f*, the connection is open for a relatively long period. If, however, in this situation the rotor 25 rotates faster, a correspondingly shorter opening period is available. During a long opening period more refrigerant can flow into the corresponding evaporator than during a short opening period.

Also here, a reversing of the rotation direction of the rotor 25 can exclude a predetermined outlet opening 30*a*-30*f* from the connection to the inlet 11, so that an evaporator connected to this outlet opening 30*a*-30*f* receives no refrigerant at all for a certain period.

The fact that now the distributor 5 does not only assume the function of a distribution, but also comprises a valve 12 for each evaporator, causes that the expansion valve can be spared.

The pipes leading to the individual evaporators must no longer have the same length, as the valves 12 control the acting of the refrigerant upon the individual evaporator.

In a manner not shown in detail, one single sensor can be arranged in front of the condenser 3 or in front of the compressor 2 instead of or additionally to the sensors 8*a*-8*d*. This sensor is then not able to evaluate the desired information for each evaporator or evaporator path individually. If, however, the operation behaviour of the refrigeration system is known, for example the various flow resistances, the information required to determine, which evaporator path 7*a*-7*d* shall receive which amount of refrigerant, can also be obtained by means of only one single sensor.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A refrigeration system with a refrigerant circuit comprising several evaporation paths and a distributor causing a distribution of refrigerant to the evaporation paths, the distributor comprising, for each evaporation path, a controllable valve, the valves being controlled by a control device, which controls the individual valves differently at least by controlling supply of the evaporator paths individually, wherein the control device controls only one single valve to open at a time so that each evaporator path being supplied with an amount of refrigerant, which each evaporator path requires and so that an evaporator path, from which a large refrigeration output is required, receives correspondingly more refrigerant than an evaporator path, from which a smaller refrigeration output is required.

2. The refrigeration system according to claim 1, wherein the control device comprises a rotor, which causes the opening of valves.

3. The refrigeration system according to claim 2, wherein the rotor is driven by a motor with variable speed.

4. The refrigeration system according to claim 3, wherein the control device is setting the opening duration of each individual valve separately by varying a rotational speed in such a manner that a connection between the inlet and one of the outlet openings is always available for a certain period.

5. The refrigeration system according to claim 3, wherein the motor is reversible.

6. The refrigeration system according to claim 2, wherein the rotor is connected to a cam disc and the valves comprise valve tappets, which are operable by the cam disc.

7. The refrigeration system according to claim 6, wherein the cam disc comprises one single cam.

8. The refrigeration system according to claim 7, wherein in the rotation direction the valve tappets have a distance from one another, which is at least as large as the extension of the cam in the rotation direction.

9. The refrigeration system according to claim 6, wherein the valve tappets are arranged in parallel to the rotor axis.

10. The refrigeration system according to claim 9, wherein the cam disc comprises a displacement drive, which acts in a direction parallel to the rotor axis.

11. The refrigeration system according to claim 2, wherein the rotor comprises an axially extending inlet channel, which is connected to an inlet of the distributor, and a radially extending outlet channel, whose opening can, during a rotation, be brought to overlap with outlet openings, which are connected to the evaporators.

12. The refrigeration system according to claim 11, wherein the outlet openings have a distance to each other in the rotation direction, which is at least as large as the extension of the opening of the outlet channel in the rotation direction.

13. The refrigeration system according to claim 1, wherein a sensor, which is connected to the control device, is arranged in each evaporation path.

14. The refrigeration system according to claim 1, wherein the evaporator paths are connected in series with a condenser, and a sensor is arranged in front of the condenser or the compressor.

15. A refrigeration system with a refrigerant circuit comprising several evaporation paths and a distributor causing a distribution of refrigerant to the evaporation paths, the distributor comprising, for each evaporation path, a controllable valve, the valves being controlled by a control device, which controls the individual valves differently by varying a duration that each valve is opened from the durations that the remainder of the valves are opened, wherein the control device controls only one single valve at a time.

16. The refrigeration system according to claim 15, wherein the control device comprises a rotor driven by a motor with variable speed, which causes the opening of the valves, and wherein the control device varies the durations that the controllable valves are open by varying the speed of the motor.

17. The refrigeration system according to claim 16, wherein the rotor is connected to a cam disc comprising one single cam and the valves comprise valve tappets, which are operable by the cam disc, and wherein in the rotation direction the valve tappets have a distance from one another, which is at least as large as the extension of the one single cam in the rotation direction so that the cam operates on only one valve tappet at a time.

18. A refrigeration system with a refrigerant circuit comprising several evaporation paths and a distributor causing a distribution of refrigerant to the evaporation paths, the distributor comprising, for each evaporation path, a controllable valve, the valves being controlled by a control device, which controls the individual valves differently at least by varying a duration that each valve is opened, wherein the control device controls only one single valve to open at a time, and wherein the control device controls the duration that a first controllable valve is opened to be different than at least the duration that a second controllable valve is opened.

19. The refrigeration system according to claim 18, wherein the control device comprises a rotor driven by a motor with variable speed, which causes the opening of the valves, and wherein the control device varies the durations that the controllable valves are open by varying the speed of the motor.

20. The refrigeration system according to claim 19, wherein the rotor is connected to a cam disc comprising one single cam and the valves comprise valve tappets, which are operable by the cam disc, and wherein in the rotation direction the valve tappets have a distance from one another, which is at least as large as the extension of the one single cam in the rotation direction so that the cam operates on only one valve tappet at a time.

* * * * *